United States Patent [19]

Förster et al.

[11] 4,015,829

[45] Apr. 5, 1977

[54] APPARATUS FOR APPLYING GLUE TO FIBER MATERIAL

[75] Inventors: Hermann Förster, Paderborn; Wilhelm Schlüter, Schwaney; Horst Sterr, Siebenstern, all of Germany

[73] Assignees: Wilhelm Lodige; Fritz Lodige; Josef Lucke, all of Paderborn, Germany

[22] Filed: Mar. 4, 1976

[21] Appl. No.: 664,048

Related U.S. Application Data

[63] Continuation-in-part of Ser. No. 502,630, Sept. 3, 1974, abandoned.

[30] Foreign Application Priority Data

Sept. 1, 1973 Germany ..... 2344231

[52] U.S. Cl. ..... 259/9; 259/25

[51] Int. Cl.[2] ..... B01F 7/04

[58] Field of Search ..... 259/9, 10, 25, 26, 45, 259/46, 68

[56] References Cited

UNITED STATES PATENTS

| | | | |
|---|---|---|---|
| 2,125,455 | 8/1938 | McLean | 259/9 |
| 2,907,555 | 10/1959 | Engels | 259/9 |
| 3,346,240 | 10/1967 | Lavelle et al. | 259/26 |
| 3,734,471 | 5/1973 | Engels | 259/10 |
| 3,843,100 | 10/1974 | Haas | 259/25 |

FOREIGN PATENTS OR APPLICATIONS

| | | | |
|---|---|---|---|
| 1,080,978 | 5/1960 | Germany | 259/9 |

*Primary Examiner*—Billy S. Taylor
*Attorney, Agent, or Firm*—Walter Becker

[57] ABSTRACT

An apparatus for applying glue to the fibers of material, such as wood and the like, especially to cellulose-containing fibers, in which the fibers are supplied to one end of a substantially horizontal drum and removed from the other end thereof with the fibers being impelled through the drum by impelling elements mounted on a central shaft rotatable in the drum and at the inlet end of the drum. Glue is applied to the material downstream from the impelling elements, and downstream from the region of glue application the material is intensively combed by tapering elements mounted on the central shaft. The glue is applied by radial elements mounted on the central shaft and to which glue is supplied through the shaft.

9 Claims, 2 Drawing Figures

APPARATUS FOR APPLYING GLUE TO FIBER MATERIAL

RELATED APPLICATION

This application is a continuation-in-part of my copending application: U.S. Ser. No. 502,630, filed Sept. 3, 1974, entitled: METHOD AND DEVICE FOR APPLYING GLUE TO FIBER MATERIAL: Inventors: Hermann Forster et al which application is now abandoned.

The present invention relates to an apparatus for applying glue to fibers of wood, bagasse or the like, in particular cellulose containing substances in which glue is added to fibers being moved whereupon the mixed substance is kept in movement for distributing the glue.

BACKGROUND OF THE INVENTION

Heretofore known devices for applying glue to fibers, according to which a shaft centrally arranged in a drum-shaped mixing chamber, has tools rotating thereon in the operating range of which the mixed substance passes after glue has been added, are employed for applying glue to fibers as well as to chips or the like. The design of these heretofore known machines is based on the finding that for purposes of obtaining a homogeneous mixture a particularly well distributed addition of the glue is of less importance than a fast homogenization of the mixed substance after the addition of glue by moving the chips or the like under a moderate pressure relative to each other. Such chip movement will cause the glue which is supplied to the chip material to become distributed uniformly in the material.

For purposes of obtaining the wiping effect between particles or fibers of the material which will result in uniform distribution of the glue thereon, the tools in the mixing zone adjacent the glue applying zone are in most instances provided with front surface portions of substantial area which are inclined toward the advancing direction and which, while the mixing substance is being agitated, exert a moderate pressure on the material and thus press the particles against each other.

Due to the simultaneously generated relative movements between the particles, an intensivewiping of the glue therebetween will be realized. During the agitation of the material being mixed, those particles which are adjacent the tool slide along the inclined surface parts of the tool while due to the lateral deviation of the adjacent particles relative to the advancing direction of the tools, the pressure required for an intensive wiping effect is generated in the adjacent mixed substance. Under the influence of this pressure, the adjacent material starts moving and escapes toward the side while, however, the pressure in the material by a correspondingly long design of the inclined sliding surfaces on the tool can be maintained also during this escaping movement.

Therefore, an intensive wiping of the glue by friction within the material requires distinct sliding operations of the material along the tool so that such tools in their range of operation may heat up and may have to be cooled by special cooling operations.

While with apparatus of the nature described, a uniform application of glue to chips and particles and the like can be obtained in such a manner so that it becomes possible to produce veneer or plywood plates of high qualities, experience has shown that fiber plates produced from fibers to which the glue has been applied in this manner have properties which reduce the quality.

More specifically, such fiber plates contain a plurality of brittle glue enclosures in the form of nests or spots. The felting of the individual fibers in the plates as it is desired in order to obtain high strength, is harmfully effected by ball-shaped rolled up agglomerates which are created by tools on the shaft having broad surface areas which engage the mixture of glue and fibers. Furthermore, such plate contains enclosures of quantities of fiber particles which have received too much glue and are compressed to a too-great extent and, in addition thereto, have the fibers oriented in one direction, said quantities of fiber particles having been formed by the formation of deposits on machine parts of the glue applying device.

Such faults in the fiber plate are all the more serious since such fiber plates, due to their homogeneous felted and layer-free texture, may be qualitatively particularly high-grade plates and may be particularly solid and well machinable. The above-mentioned faults, when occurring in the finished fiber plate, reduce, however, the important fundamental advantages of a fiber plate so that such fiber plates heretofore could frequently not be used because it was not possible to manufacture the same substantially free from faults and in an economical manner.

Experience has shown that glue-fiber agglomerates are formed by the friction and wiping effect which is favorable for the application of glue to the chips, and it was, furthermore, found that heretofore known machines and tools due to their flat design offer too much sliding and rolling-up surfaces to the fiber-glue mass. Due to the distinctive sliding movement between the mixed substance and the sliding surfaces of the tool which sliding movement and sliding surfaces are necessary for obtaining a good intermixture of the glue during the application of the glue to the chips, the fibers containing a high proportion of glue are held in this position.

This brings about the formation of ball-shaped rolled-up glue-fiber agglomerates with frequently too high a proportion of glue. On the other hand, a wiping of the glue within the adjacent regions of the material occurs only to a rather limited extent so that the glue enclosures are not broken up.

The problem underlying the present invention consists in so designing the glue application of the above-mentioned general type that a rolling-up or a formation of nests in the fiber material after the addition of glue will be avoided.

BRIEF SUMMARY OF THE INVENTION

The problem underlying the present invention has been solved in conformity with this invention by subjecting the mixed substance in a forward driving device to pulses acting point-wise or along lines. In this way, distinct frictional operations with large surface contact are avoided, and the mixed substance is, while minimizing the occurring frictional effects, subjected to a moving process which brings about a low pressure intermixture.

The point-wise or line-wise effect of the pulses not only avoids a distinct surface contact and thus the disadvantageous frictional operations inherent thereto, but at the same time brings about a fine combing of the material whereby glue-fiber agglomerates which might form are immediately separated.

A device according to the invention for applying glue to fibers of wood, bagasse, or the like, especially cellulose-containing substances, comprises, in conformity with machines employed for applying glue to the chips, a shaft which is centrally arranged in a drum and which is equipped with radial tools. The fibrous material is introduced into one end of the drum and is first subjected to the action of driver elements which move the material toward the other end of the drum which is provided with a discharge opening.

After the addition of glue, the material moves into the range of action of said tools while, however, the tools are in conformity with the invention designed in the shape of tools which taper inwardly in a direction away from the shaft somewhat like needles. The thickness of the needle-shaped tools is at least in the region close to the wall, for generating the point-wide or linewise pulses, selected below 5mm, preferably even below 3mm.

The tools may be thin and steel, especially spring steel, is particularly suitable for such tools.

For purposes of obtaining locally differentiated action of the needle-shaped tools upon the material, the tools may, according to a preferred design of the invention, be bent out of the radial direction at least in the region close to the wall of the drum. If the tools are bent off in the direction of movement of the tools at the ends thereof close to the wall, the material is subjected to a radial inwardly directed component and the material close to the wall will be deviated in the direction toward the interior of the mixing chamber, while, furthermore, the frictional contact of the material with the wall of the drum will be reduced.

By correspondingly selecting the number of the mixing tools and, in particular, the axial spacing thereof on the mixing shaft, which spacing according to a preferred embodiment of the invention should be less than half, preferably less than a third of the inner diameter of the mixing chamber, it is possible, also, with a certain preselected circumferential speed of the tools, to prevent the material from forming in the drum which may be desired when applying glue to chips.

In this way, the intensity of the frictional contact of the mixed material with the drum wall will be reduced further so that a rolling up or an agglomerating of the mixed material into clumps not only on the tools, but also on the drum wall, will be prevented to a major extent.

Also, compacted or agglomerated clumps in the material, and which have a relatively greater weight-volume ratio, are centrifuged into the radially outer region of the drum where they pass into the region of the ends of the tools, which are bent off in particular in the direction of rotation, and are intensively beaten by the higher tool speed prevailing in the radially outer regions and are thus split up.

It is, therefore, an object of the present invention to produce substantially fault-free fiber plates or the like bodies of fiber material and to do so economically.

The exact nature of the present invention will become more clearly apparent upon reference to the following detailed specification taken in connection with the accompanying drawings in which.

DETAILED DESCRIPTION OF THE INVENTION

Figure 1:
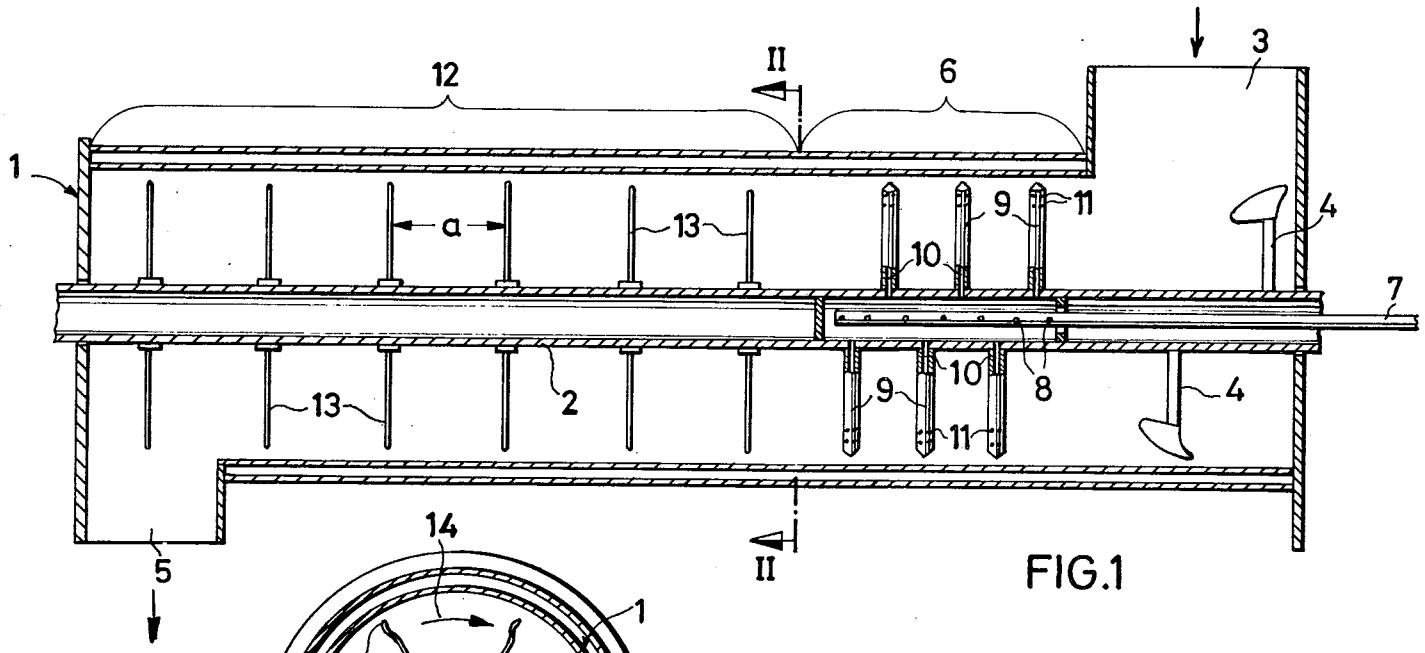
FIG. 1 illustrates a longitudinal section through a glue applying device according to the invention.
Figure 2:
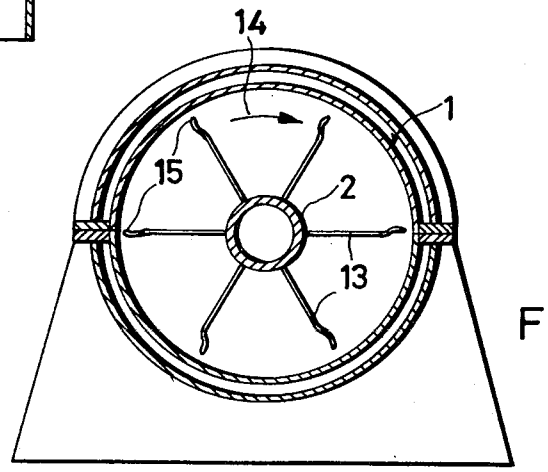
FIG. 2 represents a cross section taken along the line II—II of FIG. 1.

Referring now to the drawing in detail, the glue applying device according to the present invention diagrammatically illustrated in FIGS. 1 and 2 comprises a longitudinally extending cylinder shaped mixing chamber or drum 1 having coaxially arranged therein a mixing shaft 2. At the right hand end (with regard to FIG. 1) of the mixing chamber 1 there is provided an inlet chute 3 through which fiber material may be introduced from above into the mixing chamber 1.

In this axial region of the chute 3, the mixing shaft 2 is equipped with specially designed intake tools 4 which subject the fiber material to rotation and convey the same in axial direction to the outlet chute 5 which is located at the left hand of drum 1 as it is seen in FIG. 1.

Under the influence of this conveying movement, the fiber material first passes into a glue applying zone 6 in which the glue is applied to the fibers. According to the invention, a glue feeding pipe 7 is provided in the interior of the mixing shaft 2. The pipe 7 is in the axial region of the glue applying zone 6 at its circumference provided with glue exit openings 8, through which the glue can enter the interior of the hollow mixing shaft 2 and by a centrifugal effect can form a film on the inner wall of the mixing shaft 2.

From the inner chamber of the mixing shaft 2, the glue passes into feeding passages 10 and into glue adding tubes which radiate from the mixing shaft 2. From here the glue passes by centrifugal effect radially outwardly up to and into the head range of the feeding tubes 9, from where the glue passes through exit openings 11 and into and on the fiber material.

Instead of the aforementioned addition of glue from the interior, it is also possible to introduce the glue through feeding tubes into the fiber material, said feeding tubes passing from the outside through the wall of the mixing chamber 1. It is merely essential for the invention that following the introduction of the glue into the mixing chamber 1, in a glue applying zone similar to the zone 6, glue is added which is thereafter distributed as homogeneously as possible in a mixing zone 12 of the drum 1 while a rolling up and an agglomeration of the fibers is to be avoided.

In contradistinction to the heretofore known chip gluing machines in which in the mixing zone wide, for instance paddle-shaped mixing tools are provided for generating a friction at limited pressure in the mixing zone, the mixing shaft 2 in the mixing zone 12 is, in conformity with the invention, equipped with needle-shaped tools 13 which may be spring steel. The tools 13 have a thickness of a few millimeters, for instance from 1 to 3 mm, at least at the radially outer ends, so that they impart to the mixed material substantially point or line shaped pulses.

The tools 13 may be designed as slender needle wires and arranged in axially spaced relationship to each other in respective planes while in one plane there may, for instance, be uniformly distributed from four to twelve tools 13 and arranged at the circumference of the shaft. As will be seen, in particular, from FIG. 2, in the present embodiment referred to above, six tools 13 are arranged in a frame while, however, in conformity with the requirements of the individual case also a greater or smaller number may be provided and, in particular, the tools 13 of adjacent planes need not be located in the same radial plane.

The rotational speed of the mixing shaft 2 may, in this connection, be adapted to an optimum operation of the intake tools 4 and/or in conformity with the requirements in the gluing zone 6. The forward driving power in circumferential direction conveyed by the tools 13 onto the mixing material may be corresponding selection of the number of tools 13 and the distance *a* between their planes be so selected that within the region of the mixing zone 12 no closed compact ring of material will form at the inner circumference of the cylindrical wall of mixing chamber 1.

Instead, a ring of material formed approximately in the gluing zone 6 will be at least partially broken up. Because the ring of material is not compact, the tools 13 do not only become effective at their radial outer end but comb or fray the rotating fiber material over a major region of their length. The number of the tools 13 arranged in one plane may, while considering the speed of the mixing shaft 2 and of the axial conveying speed of the fiber material, be so selected that a sufficiently great proportion of the fiber material will, with each axial passage through a plane of the mixing tool 13, receive a sufficient number of fine pulses and will thus be intensively combed or frayed.

As illustrated in FIG. 2, the mixing tools 13 have their radial outer ends provided with a cranked, or bent, portion 15 pointing into the advancing direction indicated by the arrow 14. This crank portion 15 imparts upon the fiber material in the wall-near zone impulses which are directed away from the cylindrical wall of the mixing chamber or drum 1 so that the sliding of the fiber parts or components centrifuged against the wall will be prevented.

Due to this specific step for influencing the impulse direction in the wall-near region and to influence the forward driving power conveyed to the mixed material within the region of the mixing zone 12, which driving powder prevents the generation of a massive wall-near ring of material, a rollingup or agglomeration will be prevented by sliding friction on the wall of the mixing chamber 1.

In the radially outer range of the crank portion 15 of the tool 13, the average or mean rotary speed of the tools 13 is greatest and also the oscillatory movement in view of the resilient design of the tools so that here particularly strong pulses occur. These strong pulses in the radial outer range favor a beating-up of clumps of fiber and glue which might occur and which, due to their relatively high weight-volume ratio, are centrifuged out in the wall-near region and are here effectively diminuted and separated.

As will be evident from the above, the fiber material on its way from the gluing zone 6 to the discharge chute 5 is, by the machine according to the invention, intermixed substantially without pressure and friction and is continuously exposed to individual fine impulses which maintain, on one hand, a loose rotary movement of the fiber material and, on the other hand, see to it that a continuous separation or splitting up will occur of any agglomerates or the like which may form.

By means of the needle-like design of the tools 13, the fiber material is continuously combed through and beaten so that a rolling-up of the fibers and the formation of piles of fibers and of agglomerations by local felting or the like as well as the formation of deposit on the tools 13 or on the walls of the mixing chamber 1 will be avoided. The mixed material to which the glue has been applied thus will, in a homogeneous form, pass to the discharge chute 5. However, the individual fibers will, due to the wobbling rotary movements of the material, especially within the regions between the planes of the tools 13, not be oriented in the same direction but will be located at random and in loose condition.

In contrast to the heretofore known gluing machines, the discharge chute 5 is not closed by a dosing spring loaded plate because due to the only loose rotary movement in the interior of the mixing chamber 1, no sufficient pressure will be exerted upon such plate. A gluing device according to the invention thus comprises an open discharge chute 5 while the dosing may be effected by suitable adjustment of the axial delivery of the intake tools 4 or by similar steps.

The impelling means 4 are paddle-like members which engage the material and push it from the inlet end of the container toward the outlet end while simultaneously setting the material into rotary motion so that the material follows substantially a helical path along the inside of the container in moving from inlet 3 to outlet 5.

After the material in the drum moves away from the impelling means 4, glue is applied thereto by the feeding tubes or elements 9 which plow through the material and open the material up somewhat so that there is a primary distribution of glue on the material without the glue, however, uniformly wetting all of the particles or fibers of the material. Due to the action of impelling means 4, together with the action of the elements 9 in maintaining the material in motion, the material continues on into the mixing zone where the material is maintained in rotary motion by the needle-like mixing members 13 while the material continues to move toward outlet 5 due to the impelling means 4.

During the movement of the material through the mixing zone, the relative movement between the needle-like members 13 and the material, combs through the material and distributes the glue in the material so that all fibers and parts in the material become uniformly treated with the glue material.

Further, the radially outer ends of elements 13 are bent off in the planes of movement thereof so as to be concave on the leading side, as will be seen in FIG. 2, and the configuration thus imparted to the mixing elements assists in causing relative motion between the individual fibers and particles of the material and, especially, maintains the material in a live condition adjacent the circumferentially inner wall of the container where the possibility exists that a dead region could exist.

At no time after the application of glue to the material is the material subjected to the action of paddle-like impelling elements similar to those indicated by reference numeral 4 in FIG. 1. In the absence of engagement of the material by such elements after glue has been added to the material, the tendency for the material to form into balls or agglomerates is not encountered.

Rather, any tendency for the material to agglomerate is prevented by the action of the needle-like mixing members 13. The result is that the material, when discharged through outlet 5, is extremely uniformly admixed with the glue added thereto and a superior product results when the material is hot pressed to form boards and the like for construction and similar purposes.

It is, of course, to be understood that the present invention is, by no means, limited to the specific showing in the drawing but also comprises any modifications within the scope of the appended claims.

What is claimed is:

1. A device for applying glue to fibers of wood and like material, and for distributing the glue in the material, which includes in combination: a substantially horizontally disposed drum-shaped container having an inlet in the top at one end for admitting the material to which glue is to be applied, and having an outlet in the bottom at the other end for discharge of said material with the glue applied uniformly thereto, said drum-shaped container comprising a first axial zone adjacent to and communicating with said inlet, glue applying means in said first zone for the application of glue to fiber material supplied to the drum through said inlet, said drum-shaped container also comprising a second axial zone forming a mixing chamber in which said material and the glue applied thereto are thoroughly intermixed, said mixing chamber communicating at one end with said first axial zone and at the other end with said outlet, a shaft extending through said drum-shaped container on the axis thereof and rotatable therein, needle-shaped tools arranged in groups on said shaft in said second axial zone and extending in radial direction from said shaft to near the inner wall of said mixing chamber, said groups of needle-shaped tools being located on said shaft in axially and circumferentially spaced relationship to each other, said shaft having material impelling means thereon within the range of said inlet at the upstream end of said first zone and also upstream from said glue applying means and forming the sole means to impel material supplied to the drum via said inlet toward said outlet, said glue applying means comprising radial elements mounted on said shaft in said first zone and extending to near the inner wall of said chamber, said elements being tubular and having perforations therein, and means for supplying glue to said elements via said shaft, said material following a generally helical path along the inner wall of said container under the combined influences of said impelling means and said elements and said needle-shaped tools.

2. A device in combination according to claim 1 in which the thickness of the needle-shaped tools at least in the region adjacent the inside of said drum-shaped container is below 5mm.

3. A device in combination according to claim 1 in which the thickness of the needle-shaped tools at least in the region adjacent the inside of said drum-shaped container is below approximately 3mm.

4. A device in combination according to claim 1 in which the needle-shaped tools at least within the regions thereof adjacent the inner wall surface of said drum-shaped container are bent in the planes of rotation thereof so as to be concave toward the leading sides thereof.

5. A device in combination according to claim 1 in which said needle-shaped tools are formed of steel.

6. A device in combination according to claim 1 in which said needle-shaped tools are formed of spring steel wire.

7. A device in combination according to claim 1 in which said needle-shaped tools on said rotatable shaft are arranged in radial planes perpendicularly located with regard to the longitudinal axis of said rotatable shaft, each plane containing a plurality of said needle-shaped tools.

8. A device in combination according to claim 1 in which the spacing of said needle-shaped tools in axial direction of said rotatable shaft is less than half the inner diameter of said drum-shaped container.

9. A device in combination according to claim 1 in which the spacing of said needle-shaped tools in axial direction of said rotatable shaft is less than one-third the inner diameter of said drum-shaped container.

* * * * *